US006098768A

United States Patent [19]

Tsai

[11] Patent Number: 6,098,768

[45] Date of Patent: Aug. 8, 2000

[54] CONCEALED PULLING ROD OF LUGGAGE CASE AND WHEEL STAND CONSTRUCTION

[76] Inventor: Yen-Lung Tsai, 5F-2, No. 400, Chang Ping Rd., Sec. 1, Taichung, Taiwan

[21] Appl. No.: 09/264,890

[22] Filed: Mar. 9, 1999

[51] Int. Cl.[7] ..... A45C 13/00

[52] U.S. Cl. ..... 190/18 A; 190/115; 190/109; 190/127; 16/115

[58] Field of Search ..... 190/18 A, 109, 190/127, 115; 16/115

[56] References Cited

U.S. PATENT DOCUMENTS

| | | | |
|---|---|---|---|
| 4,583,709 | 4/1986 | Williams et al. | 190/18 A |
| 5,374,073 | 12/1994 | Hung-Hsin | 190/18 A X |
| 5,431,428 | 7/1995 | Marchwiak et al. | 190/18 A X |
| 5,476,163 | 12/1995 | Wu | 190/115 |
| 5,575,362 | 11/1996 | Franklin et al. | 190/115 |
| 5,749,503 | 5/1998 | Wulf et al. | 190/18 A X |
| 5,782,325 | 7/1998 | O'shea et al. | 190/127 X |
| 5,875,876 | 3/1999 | Wang | 190/18 A |
| 5,918,710 | 7/1999 | Sher | 190/18 A |
| 5,967,270 | 10/1999 | Shyr | 190/18 A |
| 5,970,579 | 10/1999 | Lu | 190/115 X |

*Primary Examiner*—Stephen P. Garbe
*Assistant Examiner*—Tri M. Mai

[57] ABSTRACT

A wheeled luggage is disclosed. The retractable handle is concealed in a narrow second space enclosed by rear panel and rear of luggage when not in use so as to provide an aesthetic luggage, prevent handle from being damaged by foreign objects, and provide a complete main storage space of luggage. Also, most of wheel assemblies are within the frame for eliminating an awkward obstructive protrusion of wheels.

3 Claims, 5 Drawing Sheets

CONCEALED PULLING ROD OF LUGGAGE CASE AND WHEEL STAND CONSTRUCTION

BACKGROUND OF THE INVENTION

1. Field of the Invention

The present invention relates to wheeled luggage, and more particularly to a wheeled luggage with fully utilized storage space.

2. Description of Related Art

A conventional wheeled luggage shown in FIG. 1 comprises main body 1, retractable handle 2, two wheel assemblies 3, and bracket 4 for supporting the wheel assemblies 3. As such, user may pull the retractable handle 2 along the ground. But this is unsatisfactory for the purpose for which the present invention is concerned for the following reasons:

1) The whole storage space within main body 1 is unacceptable smaller than the space of luggage due to the obstructive protrusion of wheel assemblies 3 from the main body
1. In other words, it is not a space saving design.
2) Handle 2 is susceptible to damage because it is provided outside main body 1 even after fully retracted.

Another conventional wheeled luggage is shown in FIG. 2. This luggage is characterized in that rod sleeves 5 and most part of wheel assemblies 6 are provided within the storage space of luggage. This design aims at providing a smooth appearance of luggage. But this is still unsatisfactory for the purpose for which the present invention is concerned for the following reasons:

1) Divider 9 for customizing the division of interior space of luggage, rod sleeves 5, and wheel assemblies 6 all occupy precious storage space of luggage.
2) Handle grip still can be seen from outside even after retractable handle completely retracted into rod sleeves 5. Thus retractable handle is still susceptible to damage due to collision with other objects during transporting.

Thus, it is desirable to provide a new and improved wheeled luggage in order to overcome the above drawbacks of prior art.

SUMMARY OF THE INVENTION

It is an object of the present invention to provide a wheeled luggage wherein retractable handle is concealed in a narrow second space formed by rear panel and rear of luggage being secured together by a zipper when not in use so as to provide an aesthetic luggage, prevent handle from being damaged by foreign objects, and provide a complete main storage space of luggage.

It is another object of the present invention to provide a wheeled luggage wherein most of wheel assemblies are within the main frame for eliminating an awkward obstructive protrusion of wheels.

To achieve the above and other objects, the present invention provides a wheeled luggage comprising a parallelpiped main body enclosing a first storage space including an inner frame, an outer frame, and a main frame sandwiched between the inner frame and the outer frame; two wheel assemblies each having a wheel mount and a wheel mounted to the wheel mount; and a rear panel in covering relationship to the rear of the main body to form a second storage space having the bottom sewed to the main body and other sides thereof releasably secured to the main body by a zipper; an L-shaped support plate provided in the bottom of the main frame having two openings spaced apart, each of the openings penetrates through the vertical and the horizontal portions of the support plate for receiving the wheel assembly; two U-shaped enhanced members each tightly sandwiched between the vertical portion of the wheel mount and the vertical portion of the support plate, the vertical sides of the U-shaped enhanced member abut the outer surface of the wheel assembly to form a first and a second protection edges; a retractable handle having a handle grip, a support at the bottom affixed to the support plate, and a bezel affixed to a top plate attached to the top of the main frame for receiving the handle grip when the handle is fully retracted wherein the distance between the bezel and the support is less than the vertical length of the rear panel.

The above and other objects, features and advantages of the present invention will become apparent from the following detailed description taken with the accompanying drawings.

DETAILED DESCRIPTION OF THE PREFERRED EMBODIMENTS

Figure 1:
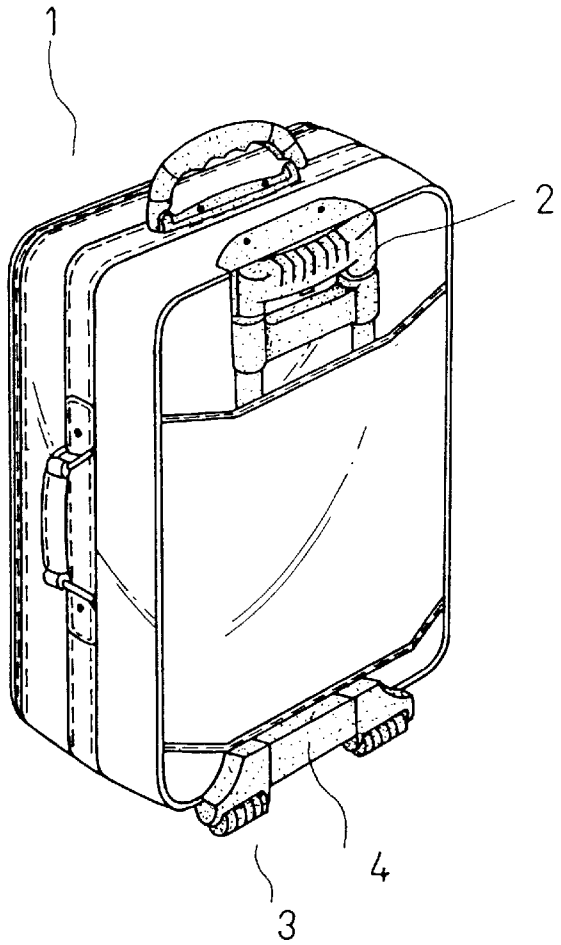
PRIOR ART FIG. 1
FIG. 1 is a perspective view of a prior art wheeled luggage.
Figure 2:
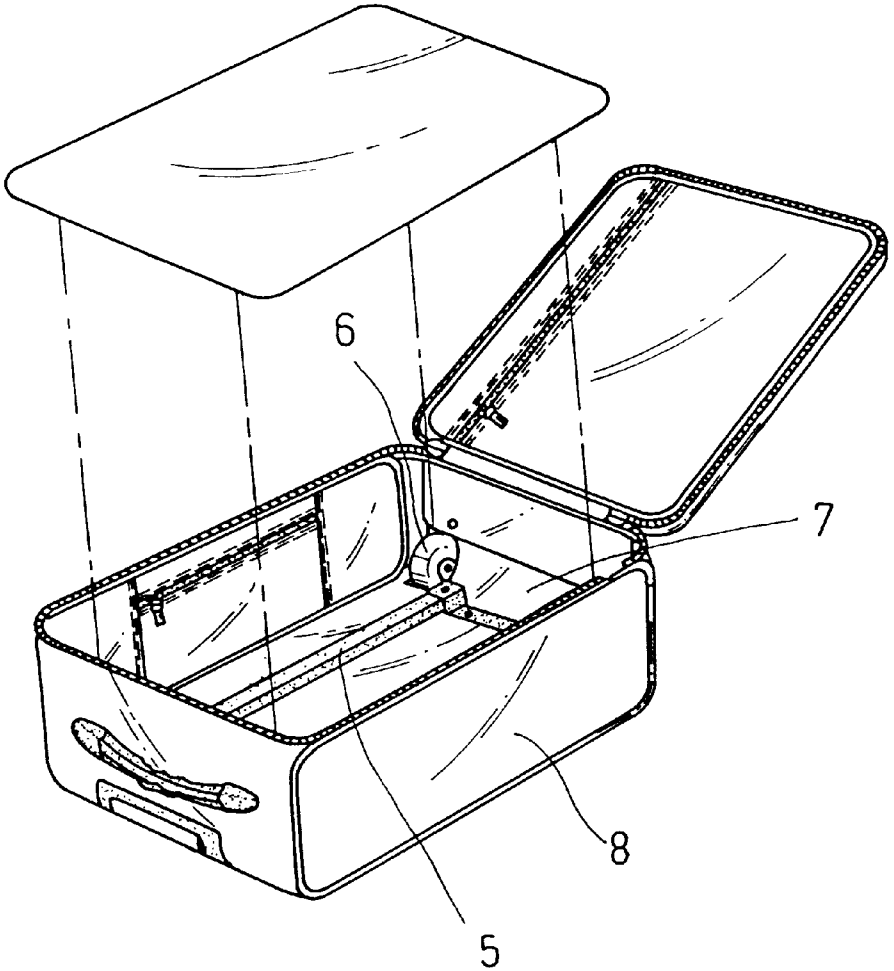
PRIOR ART FIG. 2
FIG. 2 is a perspective view of another prior art wheeled luggage with door panel open and divider separated to reveal certain interior features.
Figure 5:
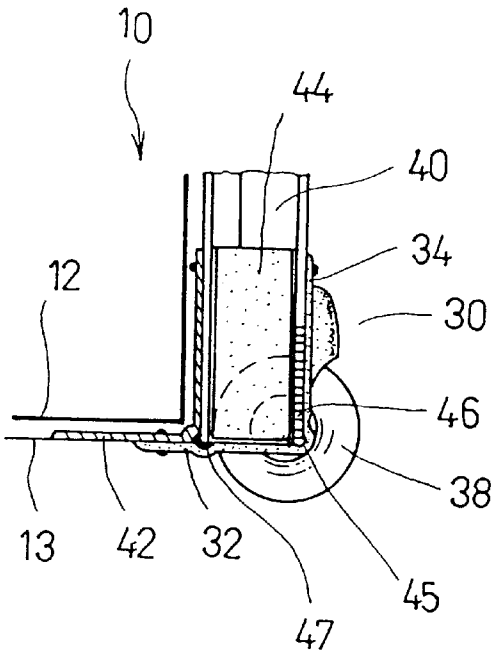
FIG. 5 is a sectional view illustrating the construction of wheel assemblies and components in its vicinity.
Figure 3:
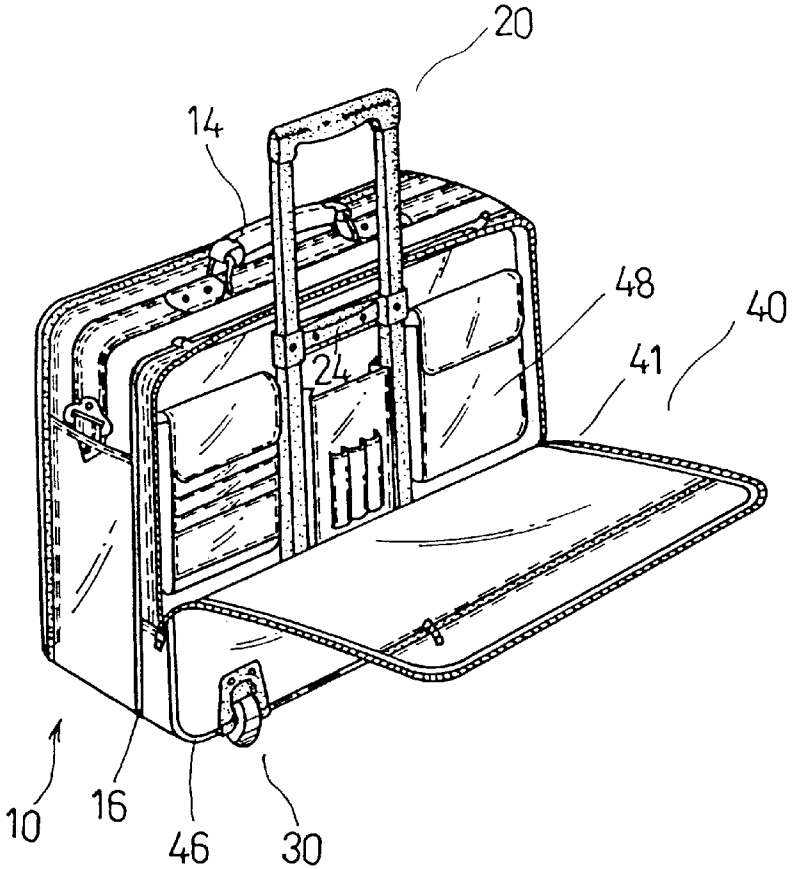
FIG. 3 is a perspective view of wheeled luggage according to the invention with rear panel partly open to reveal certain interior features.
Figure 4:
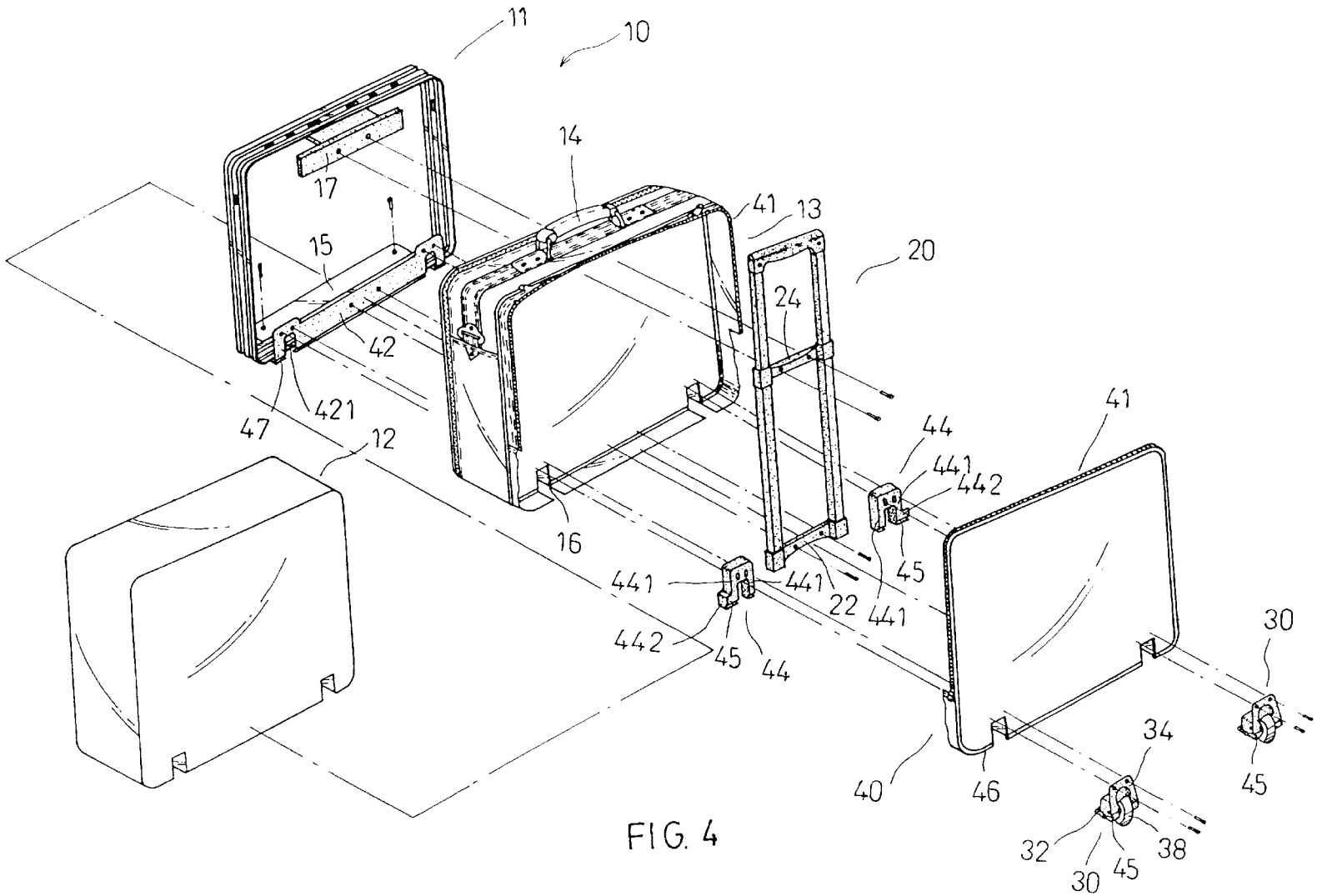
FIG. 4 is an exploded view of wheeled luggage shown in FIG. 3.

Referring to FIGS. 3–5, there is shown a wheeled luggage constructed in accordance with the invention comprising a main body 10, a retractable handle 20, and two wheel assemblies 30. Main body 10 is generally a parallelpiped comprising a rigid main frame 11 (e.g., molded thermoplastics), an inner frame 12, and an outer frame 13 both made of (e.g., fabric or canvas) wherein main frame 11 is sandwiched between inner frame 12 and outer frame 13. Lift 14 is on top of luggage for facilitating carrying. A rigid plate 15 is provided adjacent bottom of main frame 11 being sandwiched between inner frame 12 and outer frame 13 for providing an additional support of luggage.

A narrow second storage space is enclosed by rear panel 40 and rear of main body 10. The length and width of rear panel 40 is substantially the same as main body 10 wherein bottom of rear panel 40 is sewed to main body 10 and other sides thereof are releasably secured to main body 10 by zipper 41.

An L-shaped support plate 42 is provided in the bottom of main frame 11 adjacent to bottom of rear panel 40, i.e., the sandwiched between inner frame 12 and outer frame 13 (see FIG. 5). Two openings 421 are spaced apart on support plate 42 each near the horizontal end of support plate 42. Each opening 421 penetrates through vertical and horizontal portions of support plate 42. Opening 421 can receive a wheel 38.

Referring to FIG. 5 specifically, two wheel assemblies 30 are spaced in the bottom of rear panel 40. Wheel assembly 30 is mounted to a wheel mount wherein the horizontal portion 32 is slightly extended to the bottom of main body 10, while the vertical portion 34 covers a part of bottom portion of rear panel 40. Two enhanced members 44 are provided each tightly sandwiched between the vertical portion 34 of wheel mount and the vertical portion of support plate 42. Also, outer frame 13 is between enhanced member 44 and vertical portion 34. Two sides of the U-shaped enhanced member 44 abut the outer surface of wheel assembly 30 to form protection edges 441. Further, a horizontal protrusion 442 is extended from a protection edge 441 for supporting wheel assembly 30 and serving as a protection when main body 10 is collided with an object. A first concave portion 45 is formed on the bottom of horizontal protrusion 442. Correspondingly, a first member 46 is formed along the bottom edge of rear panel 40 being secured to first concave portion 45. First member 46 is of iron wire or hard plastic strip wrapped around by fabric or leather which is further sewed to main body 10. Second member 16 is provided along the bottom edge of outer frame 13. A second concave portion 47 is formed at the joint of support plate 42 and enhanced member 44 to receive second member 16 as so to prevent rear panel 40 from being collapsed under pressure.

Handle 20 is much like the conventional retractable handle. While it is important to note that retractable handle 20 is, as stated above, provided in the narrow second storage space enclosed by rear panel 40 and rear of main body 10. In detail, support 22 of retractable handle 20 is affixed to support plate 42. Bezel 24 is substantially in the center of the fully extended retractable handle 20 and is affixed to top plate 17 attached to top of main frame 11. As such, retractable handle 20 and main frame 11 are secured together for further supporting the luggage. Rear panel 40 is of soft-side (e.g., fabric) construction having a vertical length (i.e., width) slightly larger than the distance between the bezel 24 and the support 22 of the handle 20. Also, a number of pockets 48 are provided within the narrow second storage space (see FIG. 3) for storing items such as CD, phone book, calculator, etc. As such, a fully utilization of storage space is effected.

Figure 7:
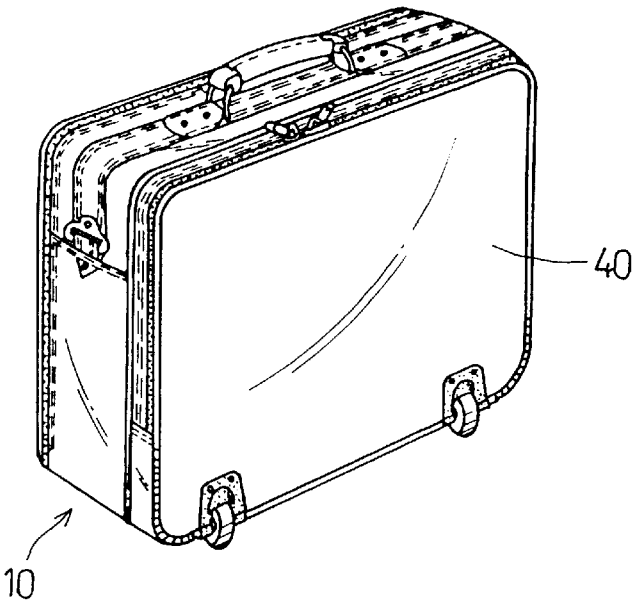
FIG. 7 is similar to FIG. 6, the retractable handle is retracted into the narrow space enclosed by rear panel and rear of luggage.
Figure 6:
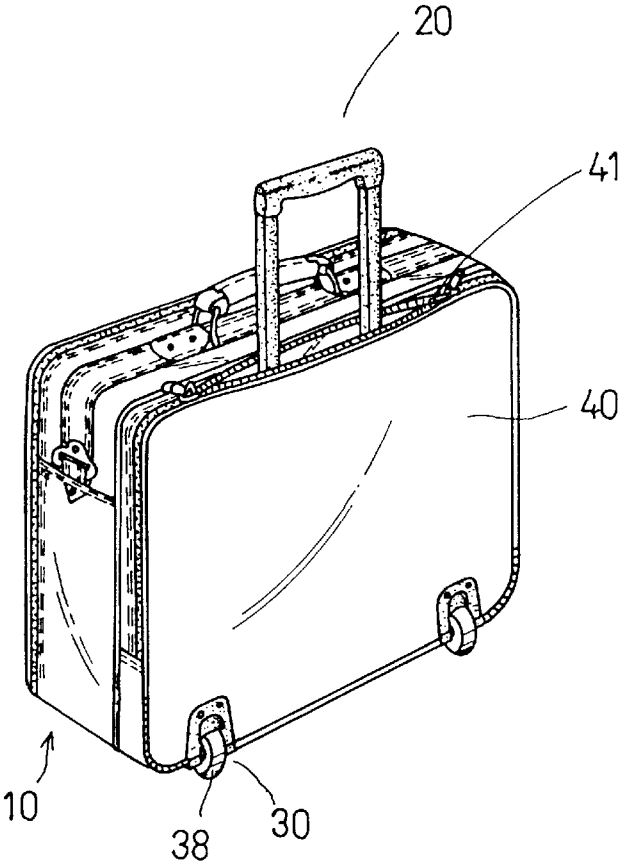
FIG. 6 is similar to FIG. 3, the retractable handle is pulled up to extend above rear panel.

Referring to FIGS. 6 and 7, the implementation of the invention is illustrated. In FIG. 6, zipper 41 is opened and retractable handle 20 is pulled to extend above rear panel 40. As such, user may pull the luggage along the ground. In FIG. 7, retractable handle 20 is fully retracted into the narrow space enclosed by rear panel 40 and rear of luggage. This is the situation, for example, luggage is ready to transport. It is seen that retractable handle 20 is protected by rear panel 40 thus from being damaged by foreign objects. Further, most part of wheel assemblies are within the luggage for eliminating an awkward obstructive protrusion of wheels, thus facilitating transportation. Moreover, user can totally customize the division of the first storage space, i.e., the main storage space of luggage, to suit the user's particular packing needs and access priorities.

While the invention herein disclosed has been described by means of specific embodiments, numerous modifications and variations could be made thereto by those skilled in the art without departing from the scope of the invention set forth in the claims.

What is claimed is:

1. A wheeled luggage comprising:

a parallelpiped main body enclosing a first storage space including an inner frame, an outer frame, and a main frame sandwiched between the inner frame and the outer frame;

two wheel assemblies each having a wheel mount and a wheel mounted to the wheel mount; and a rear panel in covering relationship to the rear of the main body to form a second storage space having the bottom sewed to the main body and other sides thereof releasably secured to the main body by a zipper;

an L-shaped support plate provided in the bottom of the main frame having two openings spaced apart, each of the openings penetrates through the vertical and the horizontal portions of the support plate for receiving the wheel assembly;

two U-shaped enhanced members each tightly sandwiched between the vertical portion of the wheel mount and the vertical portion of the support plate, the vertical sides of the U-shaped enhanced member abut the outer surface of the wheel assembly to form a first and a second protection edges;

a retractable handle having a handle grip, a support at the bottom affixed to the support plate, and a bezel affixed to a top plate attached to the top of the main frame for receiving the handle grip when the handle is fully retracted, wherein the distance between the bezel and the support of the handle is less than the vertical length of the rear panel.

2. The wheeled luggage of claim 1, further comprising a plurality of pockets within the second storage space.

3. The wheeled luggage of claim 1, further comprising a horizontal protrusion extended outwardly from the first protection edge.

* * * * *